US008139707B2

(12) United States Patent
Zemp

(10) Patent No.: US 8,139,707 B2
(45) Date of Patent: Mar. 20, 2012

(54) DEVICE FOR COUNTING PRINTED PRODUCTS OF AN IMBRICATED STREAM OF PRODUCTS

(75) Inventor: Andreas Zemp, Wolhusen LU (CH)

(73) Assignee: Müller Martini Holding AG, Hergiswil (CH)

( * ) Notice: Subject to any disclaimer, the term of this patent is extended or adjusted under 35 U.S.C. 154(b) by 784 days.

(21) Appl. No.: 12/011,294

(22) Filed: Jan. 26, 2008

(65) Prior Publication Data

US 2008/0185765 A1 Aug. 7, 2008

(30) Foreign Application Priority Data

Feb. 2, 2007 (EP) ..... 07405028.7

(51) Int. Cl.
*G06M 11/00* (2006.01)
*G06M 9/00* (2006.01)

(52) U.S. Cl. ..... 377/8; 377/17

(58) Field of Classification Search ..... None
See application file for complete search history.

(56) References Cited

U.S. PATENT DOCUMENTS

| | | | | |
|---|---|---|---|---|
| 4,139,765 | A * | 2/1979 | Pomey | 377/8 |
| 4,217,491 | A * | 8/1980 | Dufford et al. | 250/223 R |
| 4,296,314 | A * | 10/1981 | Dabisch et al. | 377/8 |
| 4,384,195 | A * | 5/1983 | Nosler | 377/53 |
| 4,450,352 | A * | 5/1984 | Olsson | 250/223 R |
| 4,481,667 | A * | 11/1984 | Price et al. | 382/321 |
| 4,807,263 | A * | 2/1989 | Ohno et al. | 377/8 |
| 5,005,192 | A * | 4/1991 | Duss | 377/8 |
| 5,022,644 | A * | 6/1991 | Burge | 271/270 |
| 5,197,012 | A * | 3/1993 | El-Sarout | 700/129 |
| 5,614,710 | A * | 3/1997 | Mondie et al. | 250/223 R |
| 6,876,716 | B2 * | 4/2005 | Sjogren et al. | 377/8 |
| 2005/0040322 | A1 * | 2/2005 | Sjogren | 250/223 R |

FOREIGN PATENT DOCUMENTS

GB 2 068 612 8/1981

* cited by examiner

*Primary Examiner* — Tuan T Lam
(74) *Attorney, Agent, or Firm* — Lucas & Mercanti, LLP; Klaus P. Stoffel

(57) ABSTRACT

A device for counting printed products of an imbricated stream includes a first measuring unit for detecting a printed product edge directed transversely of the conveying direction of the imbricated stream and with an evaluating unit which receives signals of the first measuring unit for counting the printed products. Therefore, it is the primary object to provide a device of the above-described type which facilitates a higher counting accuracy even in the case of irregular imbricated streams of products.

8 Claims, 2 Drawing Sheets

DEVICE FOR COUNTING PRINTED PRODUCTS OF AN IMBRICATED STREAM OF PRODUCTS

BACKGROUND OF THE INVENTION

1. Field of the Invention

The present invention relates to a device for counting printed products of an imbricated stream of printed products. The device includes a first measuring unit for detecting a printed product edge directed transversely of the conveying direction of the imbricated stream, and an evaluating unit which receives signals of the first measuring unit for counting the printed products.

2. Description of the Related Art

A device of the above-identified type is known in the art from U.S. Pat. No. 4,384,195. This device makes it possible to count, for example, newspapers which are conveyed in the imbricated stream prior to being shipped. For this purpose, a measuring unit is provided which includes a laser, wherein the laser directs light obliquely toward the imbricated stream. The light ray is reflected at each leading edge toward a receiver which sends appropriate signals to an evaluating unit. Between two adjacent edges, the light is reflected at the upper side of the respective printed product in such a way that the light does not reach the aforementioned receiver. Consequently, the measuring unit counts each leading edge of the respective printed products or newspapers.

In this device described above, there is the difficulty that a minimum spacing between edges of the printed products must exist in order to achieve an accurate counting result. Two printed sheets which are placed one on top of the other and printed sheets, whose spacing between the edges thereof is very small, are counted by this device as a single printed product. Accordingly, if the imbricated stream of printed products is irregular, the counting result of this device is incorrect. This means that orders can be only insufficiently monitored with respect to the number of products counted. An inaccurate counting result has the disadvantage that it may lead to overproduction or underproduction and to additional costs.

EP 1 201 582 A1 discloses a device for controlling sheets. However, in this device, the printed products are not counted, but defective sheets are detected. For determining such defective sheets, a device is provided with a capacitive sensor and at least one ultrasonic sensor. Using an output signal of an optical measuring unit, it is decided whether the sheets are controlled by means of the optical measurement unit or the capacitive measuring unit. This device makes possible a control of thin sheets as well as of thicker sheets.

EP 1 403 202 A1 discloses a method of operating a sensor for detecting sheets in a machine which processes sheets. In this method, the object is to accurately and securely distinguish between single sheets and multiple sheets with different stacking heights in sheet-processing machines. For this purpose, two different sensors are provided. Both sensors each detect the stacking height of the sheets. This method is also not suitable for counting products.

SUMMARY OF THE INVENTION

Therefore, it is the primary object of the present invention to provide a device of the above-described type which facilitates a higher counting accuracy even in the case of irregular imbricated streams of products.

In accordance with the present invention, in a device of the above-described type, this object is met by providing a second measuring unit which detects a property of the imbricated flow which deviates from the edge of the printed products. In addition, a counting result of the first measuring unit can be corrected with a measured result of the second measuring unit by means of an evaluating unit.

For example, the first measuring unit determines in a known manner the edges of the flat products and the second measuring unit measures by means of a distance meter the enveloping curve of the imbricated stream. In order to prevent a product from being detected twice by the measuring unit which detects the edges because of the difficult shapes of the edges of newspapers and magazines, no additional signals are evaluated during a certain period of time, also called dead period. Consequently, the first measuring unit counts two successive products in which the leading edges have a very small distance from each other as one product. The second measuring unit then recognizes these two products as two products because of the double thickness. By issuing an additional counting pulse from the second measuring unit, the counting result of the first measuring unit is corrected, so that the final counting result is correct. The invention has the significant advantage that because of the higher counting accuracy an underproduction or an overproduction can be prevented. The products referred to are preferably printed products, for example, newspapers, magazines, tabloids, but also individual sheets. The invention is also suitable for other flat products which can be conveyed in an imbricated stream.

The device according to the present invention makes it also possible to reliably count an imbricated stream which travels at a speed of up to 1.5 m/sec and an average minimum imbrication spacing of 30 mm. Thus, in such an imbricated stream the cycle time is approximately 20 ms. The products in the imbricated stream may be, for example, individual sheets or also folded sheets, or sheets which are folded several times, or, for example, newspapers, such as tabloids. However, the printed products may also differ from each other; thus successive printed products may be different, for example, they may be printed differently.

In accordance with a further development of the invention, the first measuring unit is constructed in such a way that it detects the leading edges of the imbricated stream or the products. The measuring unit may be operating without contact or it may also be a system which operates with contact, for example, a sensing wheel. The contactless measuring unit is preferably a light source which is directed against the imbricated stream and which interacts with two light receivers. One of these light receivers absorbs the light which is reflected at the edges of the printed products. Other electro-optical devices are also conceivable as a contactless first measuring unit, for example, a digital video camera with image processing.

The second measuring unit may also operate without contact or may be a mechanical contacting system. For example, the second measuring unit may be a mechanical scanning wheel as it is known in the art or it may be a flow scale. Conceivable as contactless measuring units are capacitive sensors or, for example, ultrasonic sensors as well as laser/distance sensors. The second measuring unit then facilitates a particularly reliable correction of the counting result of the first measuring unit if, in accordance with a further development of the invention, the enveloping curve of the imbricated stream is detected. This enveloping curve corresponds to the pattern of the thickness of the imbricated stream. Adjacent printed products with an unusually small distance within the imbricated flow or which are placed immediately one above the other, lead at the appropriate location to a particularly high thickness of the imbricated stream, thus, can be detected by means of the second measuring unit.

The second measuring unit is preferably adapted to the product thickness by means of a conventional learning algorithm. The second measuring unit is preferably triggered by the first measuring unit.

The evaluation of the signals of the two measuring units takes place in the evaluating unit. This evaluating unit has preferably a computer system which facilitates an evaluation of the information in real time. Accordingly, it is also possible to reliably count an imbricated stream which travels at a relatively high speed and in which the spacing between imbricated products is small.

In accordance with a further development of the present invention, the counting result of the first measuring unit is corrected by providing counting pulses of the second measuring unit. For example, if the second measuring unit detects two printed products which are placed one on top of the other, the counting result of the first measuring unit which includes the two printed products is corrected by the second measuring unit providing a counting pulse. The second measuring unit can, for example, further provide two counting pulses of the second measuring unit to correct the counting result of three printed products which are placed one on top of the other. This facilitates a particularly simple correction method.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
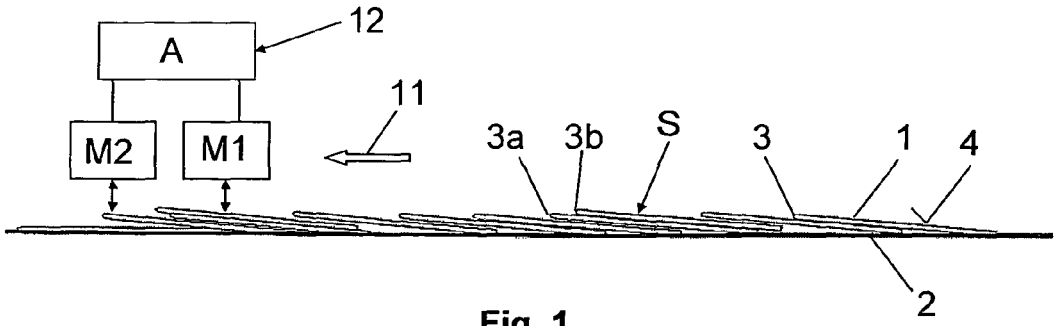
FIG. 1 schematically illustrates an imbricated stream of flat products, and a device according to the present invention.

The imbricated stream S which is shown in FIG. 1 in a side view is formed in the conventional manner by a plurality of printed products 1 or other flat products which are conveyed by means of conveying device 2 in the direction of the error 11. The printed products 1 each have a leading edge 3 which extends essentially transversely of the conveying direction or of the direction of the arrow 11. Adjacent to the edge 3 is an upper side 4 which usually is flat and may be printed. The printed products 1 may be of any configuration, i.e., they may be individual sheets or they also may be comparatively thick printed products, for example, newspapers. The printed products 1 are fed, for example, for shipment to a cross-type feeder, not shown, and are counted at that location by means of a device 12. This device 12 is arranged in FIG. 1 above the imbricated stream S. However, the device 12 may also be arranged underneath the imbricated stream S. The device 12 counts the printed products 1 which travel past the device 12. The count preferably takes place in real time, so that it is always known how many of the printed products 1 have passed the device 12.

The device 12 includes a first measuring unit M1, a second measuring unit M2 and an evaluating unit A. The measuring units M1 and M2 are each connected to the evaluating unit A for the signal transmission. The evaluating unit A includes a suitable computer system which is suitable of evaluating the information provided by the measuring units M1 and M2. The result of the evaluation may be optically indicated or also transmitted to a unit of a higher order.

Figure 6:
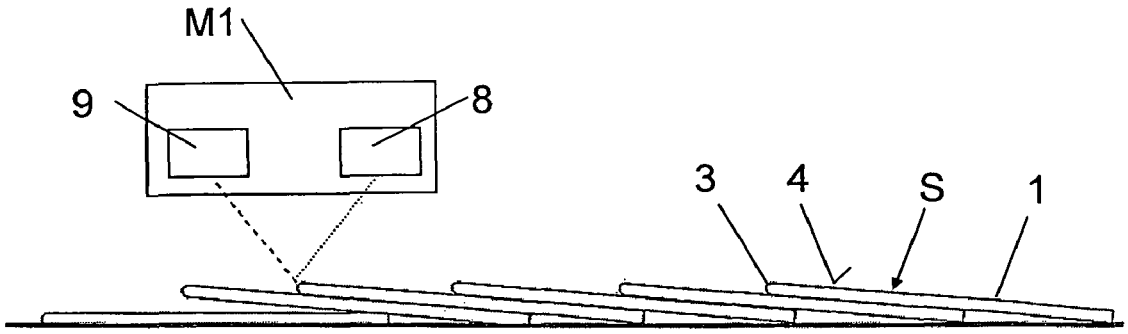
FIG. 6 schematically illustrates an imbricated stream and means for measuring the edges.

The first measuring unit M1 serves for detecting the edges 3 of the printed products 1. As seen in FIG. 6, the first measuring unit M1 includes a transmitter 8 which sends a light ray toward the imbricated stream S. If the light ray impinges upon an edge 3, the light ray will be reflected toward a receiver 9 which supplies an appropriate signal to the evaluating unit. If the light ray is reflected at the surface 4, this reflected ray does not reach the receiver 9. Also conceivable is an embodiment with a second receiver not shown which receives the rays reflected at the surface 4. In that case, the edges 3 are detected without contact. Basically, however, it is also possible, for example, to use a mechanical scanning device with a scanning wheel which is raised as each ray travels by. The raising of the scanning wheel may also be transformed into an electrical signal and supplied to the evaluating unit A.

Figure 7:
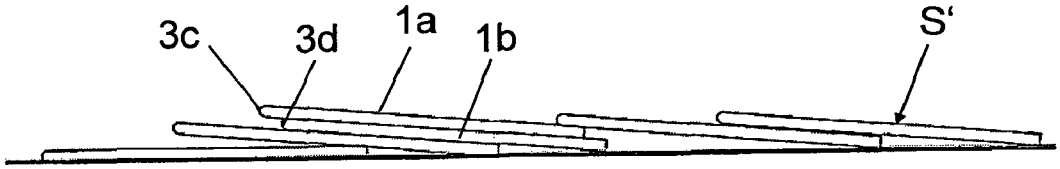
FIG. 7 schematically illustrates an imbricated stream with two printing products placed one on top of the other.

If the imbricated stream S is regular as illustrated in FIG. 6, the measurements taken by means of the first measuring unit M1 alone produce a correct counting result. However, if the imbricated stream S' is irregular as illustrated in FIG. 7, with two printed products 1*a* and 1*b* being stacked above each other in such a way that edge 3*d* is covered so that the first measuring unit M1 cannot detect the first covered edge 3*d*. In that case, the first measuring unit M1 does not count the printed product 1*b*. The first measuring unit M1 merely detects the edge 3*c* of the printed product 1*a*.

In addition, the first measuring unit M1 is not capable of distinguishing between two edges which are located very close to each other. For example, this applies to the edges 3*a* and 3*b* shown in FIG. 1. Instead of the two edges 3*a* and 3*b*, the first measuring unit M1 merely measure one edge and provides the evaluating unit A with only one signal. A second measuring unit M2 is provided in order to correctly count the printed products 1 even if they are in an irregular imbricated stream S'.

The second measuring unit M2 measure a different property of the products from the measuring unit M1. In particular, the second measuring unit M2 measures the enveloping curve of the imbricated stream S. For example, the measurement takes place capacitively with sensors which are known in the art or also by means of a digital video camera with image processing or with laser/distance sensors. Also in that case, a mechanical measurement is possible. Because a thickness measurement is carried out, the second measuring unit M2 can recognize printed products 1*a* and 1*b* which are placed one on top of each other or printed products having short imbrication spacing. By using such a detection, the counting result of the first measuring unit M1 can be corrected, for example, with a signal supplied to the evaluating unit A. This will be explained in more detail below with the aid of FIGS. 2 to 5.

Figure 8:
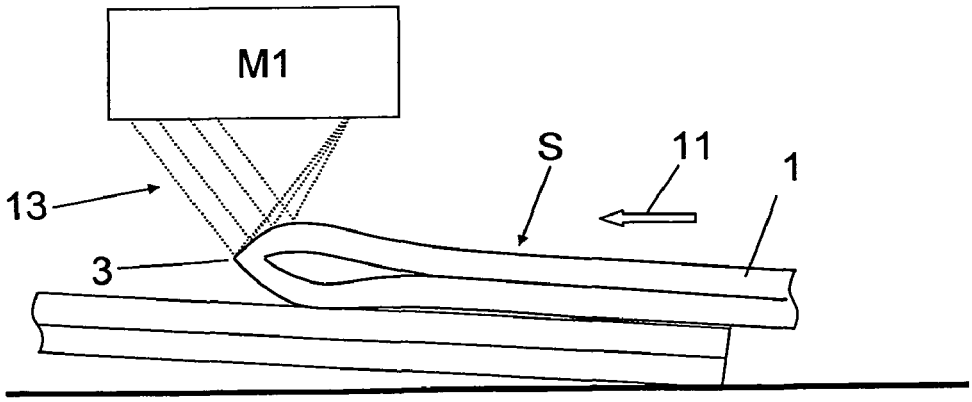
FIG. 8 illustrates the occurrence of multiple measurements in the case of thick printed products.

In the case of thicker printed products 1 such as, for example, thicker newspapers or magazines, multiple pulses 13 occurring at the edge 3 may be suppressed as illustrated in FIG. 8 by not taking into consideration any further input pulses 5 during the evaluation and the duration of an input pulse 5 and an immediately subsequent adjustable dead period 10.

Figure 2:
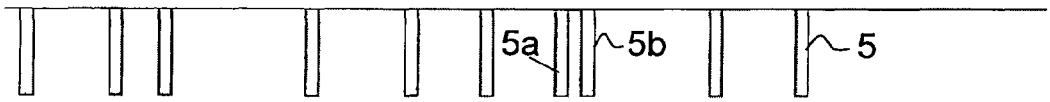
FIG. 2 schematically illustrates the input pulses in the case of an edge detection of the imbricated stream according to FIG. 1.
Figure 3:
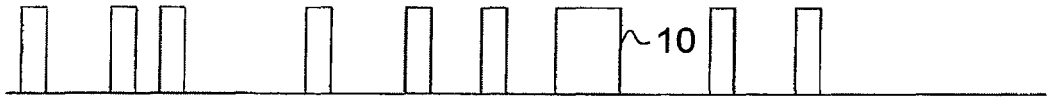
FIG. 3 illustrates the dead periods in the case of edge detection of the imbricated stream according to FIG. 1.
Figure 4:
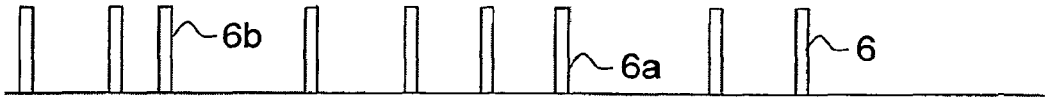
FIG. 4 shows the input pulses in the case of an edge detection of the imbricated stream according to FIG. 1.
Figure 5:
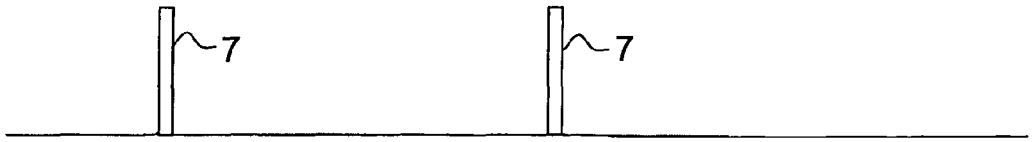
FIG. 5 illustrates the output pulses when measuring the imbricated stream according to FIG. 1 by means of the second measuring unit.

FIG. 2 shows the input pulses 5 and FIG. 3 shows the dead periods 10. The input pulses 5 of FIG. 2 are the input pulses of the first measuring unit M1. Finally, because of the dead periods, the output pulses 6 of FIG. 4 are obtained. As can be seen, the two output pulses 5*a* and 5*b* occur due to the dead period 10 and result in an output signal 6*a*. The reason for this is the very short distance between the edges 3*a* and 3*b*. The printed products 1*a* and 1*b* which are placed one on top of the other also result in only one output pulse 6*b*. Consequently, the measurement with the first measuring unit M1 alone would not detect two printed products 1. In order to correct this, as shown in FIG. 5, the second measuring unit M2 provides the evaluating unit A with the two output pulses 7 shown in FIG. 5 in the form of signals. The output pulse 7 illustrated in FIG. 5 on the left hand side was produced by the two printed products 1*a* and the additional signal was produced by the printed products 1 having the edges 3*a* and 3*b*. Consequently, the second measuring unit M2 sends a signal to the evaluating unit 1 when a thickness is discovered in the imbricated stream S which significantly deviates from the thickness to be expected. It is then decided in each case how many printed products 1 are placed on top of each other. The sum of the signals or the output pulses 6 and 7 from the first measuring unit M1 and from the second measuring unit M2 then correspond to the total sum of the printed products 1 of the imbricated stream S.

As seen in FIG. 1, the measuring unit M1 and the measuring unit M2 may be arranged one behind the other in the direction of the conveyance, as shown in FIG. 1. However, in accordance with another configuration, the measuring units M1 and M2 may also be placed next to each other, above or below the imbricated stream S. Also conceivable is a side by side arrangement approximately in the plane of the imbricated stream S. Also conceivable is an embodiment with more than two measuring units. For example, two or more measuring units may be provided for detecting the edges and/or two or more measuring units may be provided for detecting the enveloping curve. Finally, it is conceivable that one or more additional measuring units are provided for determining further properties of the imbricated stream S and to use the result for correcting the counting result.

While specific embodiments of the invention have been shown and described in detail to illustrate the inventive principles, it will be understood that the invention may be embodied otherwise without departing from such principle

I claim:

1. A device for counting printed products which travel in an imbricated stream, the device comprising a first measuring means for detecting a printed product edge directed transversely of the conveying direction of the imbricated stream, and an evaluating unit for receiving signals of the first measuring means for counting the printed products, the device further comprising a second measuring means for determining a property of the imbricated stream which deviates from the printed product edges of the imbricated stream, wherein a counting result of the first measuring means is correctable by using through the evaluating unit a measuring result of the second measuring unit, wherein the second measuring means detects the enveloping curve of the imbricated stream.

2. The device according to claim 1, wherein the first measuring means is configured to detect leading edges of the printed products forming the imbricated stream.

3. The device according to claim 2, wherein the first measuring means detects the edges without contact.

4. The device according to claim 3, wherein the first measuring means comprises a light source directed against the imbricated stream, and at least one light receiver, wherein the light receiver detects light reflected at the product.

5. The device according to claim 1, wherein the second measuring means comprises a contactless, stationary distance sensor.

6. The device according to claim 1, wherein the second measuring means comprises a mechanical scanning wheel, a capacitive measuring device or a camera with image processing.

7. The device according to claim 1, wherein the second measuring means is configured to be triggered by the first measuring means.

8. The device according to claim 1, wherein the evaluating unit is configured to evaluate the signals of the first measuring means and the second measuring means in real time.

* * * * *